US006431379B1

(12) United States Patent
Kröll et al.

(10) Patent No.: US 6,431,379 B1
(45) Date of Patent: Aug. 13, 2002

(54) APPARATUS FOR THE AUTOMATED HANDLING OF LOADS

(75) Inventors: Joachim Kröll, Jüchen; Jürgen Breitfeld, Wetter; Hermann Franzen, Mönchengladbach; Jannis Moutsokapas, Monheim, all of (DE)

(73) Assignee: Atecs Mannesmann AG, Düsseldorf (DE)

( * ) Notice: Subject to any disclaimer, the term of this patent is extended or adjusted under 35 U.S.C. 154(b) by 0 days.

(21) Appl. No.: 09/716,347

(22) Filed: Nov. 20, 2000

(30) Foreign Application Priority Data

Nov. 19, 1999 (DE) ..... 199 57 823

(51) Int. Cl.[7] ..... B66C 1/10

(52) U.S. Cl. ..... 212/319; 212/327; 294/81.2; 294/81.5; 294/81.51

(58) Field of Search ..... 212/313, 319, 212/327; 294/81.2, 81.5, 81.51

(56) References Cited

U.S. PATENT DOCUMENTS

| | | | | |
|---|---|---|---|---|
| 4,139,107 A | * | 2/1979 | Ninomiya et al. | 212/319 X |
| 4,266,904 A | * | 5/1981 | Fadness | 212/319 X |
| 5,151,006 A | * | 9/1992 | Marttila et al. | 212/319 X |
| 5,617,964 A | * | 4/1997 | Lucking et al. | 212/327 |

FOREIGN PATENT DOCUMENTS

| | | | |
|---|---|---|---|
| DE | 1 556 324 | 2/1970 | |
| DE | 43 15 791 | 11/1994 | |
| RU | 655644 | * 4/1979 | 212/327 |

OTHER PUBLICATIONS

Article from magazine fördern und heben 37 (1987) entitled "Alles über Spreader–Teil I" –pp. 889–892.

Article from magazine fördern und heben 37 (1988) entitled "Anschlaghilfen (Flipper)", p. 11.

P. 1675 of the periodical HANSA–Schiffahrt–Schifbau –Hafen–107 dated 1970.

* cited by examiner

*Primary Examiner*—Steven A. Bratlie
(74) *Attorney, Agent, or Firm*—Cohen, Pontani, Lieberman & Pavane

(57) ABSTRACT

An automated load handling apparatus is provided for handling loads fastened to a spreader having corners and a load suspension mechanism. The load handling apparatus includes a lifting yoke having a horizontal supporting framework that may be suspended at its comers to the spreader, four axially displaceable pendulum supports arranged between the lifting yoke and the spreader for supporting the lifting yoke, a rigid load guide including a lifting mechanism having ropes corresponding to comers of the lifting yoke that may be fastened to the load suspension mechanism of the spreader, and a cylinder pair 7.1, 7.2 arranged toward an end of the lifting yoke. The cylinder pair 7.1, 7.2 provides torque support to the lifting yoke relative to the load guide and is capable of displacing and/or pivoting the lifting yoke relative to the load guide. A sensor mechanism is arranged in the cylinder pair for detecting relative orientation of the lifting yoke relative to the spreader and/or the load guide. Further cylinder pairs may be provided to act as dampers when the spreader is set down on the container.

11 Claims, 11 Drawing Sheets

APPARATUS FOR THE AUTOMATED HANDLING OF LOADS

BACKGROUND OF THE INVENTION

1. Field of the Invention

The present invention relates to an apparatus for automated handling of loads fastened to load suspension means of a handling appliance. More particularly, the present invention relates to an apparatus for automated handling of ISO containers, by means of a spreader.

2. Description of the Related Art

German reference 1 556 324 discloses a generic type of spreader for handling containers. The aim of the known design is to provide an apparatus for picking up the containers that engages the corresponding locking parts of the container even if the container is on uneven ground or is somehow twisted or distorted. To this end, various measures are proposed, including connecting the spreader to the lifting yoke by pendulum support. The pendulum supports are designed so as to be axially displaceable relative to the lifting yoke. German reference 1556 324 also teaches a flexible connection to ensure that the spreader can be better adapted to the container.

Automated container terminals are known using various load suspension means. The design of these is dependent upon special conditions existing in each case at these terminals and cannot be transferred to other terminals. The spreaders, likewise equipped with lifting yokes, have the disadvantage of either a high dead weight or a large overall height. In normal container terminals having stacking heights of three or four meters, every additional meter in height of a crane runway support involves progressively rising costs for the terminal. In addition, the known lifting yokes also entail considerable design and manufacturing costs, which it is desirable to reduce.

SUMMARY OF THE INVENTION

The object of the present invention is to provide an apparatus for use in handling appliances, i.e., for picking up and setting down ISO containers so that it is possible to automate handling of the load. This is required for automatic use of, for example, a container stacking crane.

The present invention uses a generic type of lifting yoke on the spreader and ensures safe and automatic use of the spreader, while being designed in a simple, functionally reliable and cost saving manner.

To achieve the object, the generic type apparatus is improved because the lifting mechanism is part of a rigid load guide. A cylinder part is linked between the lifting mechanism and the lifting yoke both as a torque support and for displacement and pivoting of the lifting yoke relative to the load guide. Sensors are provided in the cylinder pair so that the relative orientation of the lifting yoke with respect to the spreader and/or to the load guide can be detected in each position.

The apparatus of the present invention uses a handling appliance having a rigid load guide which can absorb horizontal forces that occur during handling of the load. Rigid load guides include, for example, rope zones of a crane trolley, quadruple frame guides of straddle carriers or vertical guides of a beam in a container stacking crane. Cylinder pairs are arranged between the load guide and the lifting yoke permitting a length and angular adjustment of the lifting yoke relative to the load guide and also permitting a horizontal movement and a tilting movement of the lifting yoke in the transverse and longitudinal directions. All the movements of the lifting yoke are detected and indicated or processed by a sensor system.

Preferably, the cylinder pair is arranged so that the two piston/cylinder units describe the sides of an isosceles triangle, at least when the pair is in the retracted state. Both cylinders are linked to the lifting yoke in the region of the tip of the isosceles triangle. The opposite ends of the piston/cylinder units are fastened in an articulated manner in a common horizontal plane on both sides of the load guide. In this way, the cylinder pairs can also act as a torque support, the fixed points of which consist of two spherical plain bearings on the load guide and one pivoting bearing pair on the lifting yoke. The cylinder pairs are preferably actuated via a central hydraulic system, to allow for correction of the rotary and longitudinal axis for fine positioning of the spreader for the container or containers relative to the aiming point, (i.e., truck loading frame). Fine positioning of the lifting yoke in the transverse direction is preferably effected with the crane trolley travel of the handling appliance.

According to a preferred embodiment of the present invention, the cylinder pair consists of double acting individual cylinders which are firmly connected to one another at their base flanges. This permits favorable control of the individual cylinders.

In a more preferred embodiment of the present invention, the load guide is formed by the vertically guided guide column of a corresponding handling appliance. The lifting yoke is supported in its transverse direction on the guide column by means of a guide running in the longitudinal direction of the yoke. As a result, the lifting yoke is fixed relative to the guide column in the transverse direction, i.e., in the travel direction of the trolley, whereas a displacement is possible in the longitudinal direction.

According to a further embodiment of the present invention, the guide is preferably designed as a guide rail for a running roller, which is arranged at the front end of the guide roller, is rotatable about a horizontal axis, and is assigned to lateral supporting rollers which can roll on the flanks of the guide rail. The running surfaces of the running roller and d of the supporting rollers are of crowned design. Thus, the running rail running in the center of the lifting yoke and the supporting roller unit, together with the horizontally acting running roller and the two smaller, symmetrically arranged guide rollers, form the bearing point of the guide column. The crowned design of the running surfaces serves to permit rotation of the lifting yoke relative to the guide column. A displacement of the lifting yoke relative to the guide column by about ±500 mm is possible in the longitudinal direction of the lifting yoke, i.e., in the travel direction of the bridge. The apparatus according to the present invention permits pivoting of about ±5° about the rotary axis of the guide column, i.e., about its longitudinal axis.

The cylinder pairs are fastened on both sides of the guide column and enable the apparatus according to the present invention to be put into a defined zero position after the spreader has been lifted.

The spreader may be connected to the lifting yoke, for example, via four pendulum supports. According to a still further embodiment of the present invention, piston/cylinder units are arranged essentially horizontally while being oriented transversely between the lifting yoke and spreader. The cylinder spaces of the piston/cylinder units can be operated so as to be unpressurized when the spreader is being set down on the container. As such, the piston/cylinder units can act as fixing and damper elements. One end of the respective cylinder pairs is connected to the lifting yoke by spherical plain bearings, whereas the other end is mounted on the spreader. In a preferred embodiment, three cylinder pairs are used with two being arranged in the travel direction of the trolley near the suspension points of the pendulum supports. The other cylinder pair is located in the travel direction of the bridge centrally in the direction of the spreader longitudinal axis.

Depending on the wind force acting on the load, the movement can be damped by specific hydraulic pressure in the cylinder pairs. The relative movement between the lifting yoke and the spreader as a reaction to placement of the spreader on the container or containers on the aiming point is made possible by free operation of the cylinder pairs. The horizontal adjusting travel of the spreader axes in the longitudinal and transverse directions is ±200 mm for each axis; this is ensured by the mechanical end positions of the piston and piston rods of the respective cylinder pairs.

In addition, a mechanical stop may be provided between the lifting yoke and spreader to limit the vertical clearance space between the components. This clearance space should preferably be about 200 mm between the lifting yoke and spreader. The mechanical stop comes into effect after an approximately 210 mm vertical stroke and is dimensioned so that the weight of the lifting yoke and guide column is absorbed in a statically safe manner. The stop also serves as a rest for the lifting yoke on the spreader when the two parts are transported together.

In a further embodiment of the present invention, the complete hydraulic unit, the electrical control and the data communication of both the spreader and the lifting yoke are arranged on the spreader. All the hydraulic cylinders are supplied from the power pack of the spreader. Quick release couplings for the hydraulic hoses and plugs for the cable connections form a clear and universal interface. This ensures rapid and simple exchange of the spreader, even in the case of different makes.

All the orientations of the spreader relative to the lifting yoke can be electronically detected and evaluated. To this end, the spreader is equipped with all the sensors necessary for automatic operation. These sensors electronically detect and signal all the positions of the spreader and feed them to the evaluating means. These detected positions also include the inclination and tilt of the spreader in the bridge and trolley travel direction during delivery and lifting of the container.

The orientation of the spreader in the bridge and trolley travel direction is preferably detected via the movement of the pendulum supports relative to the suspension in the lifting yoke. To this end, an elastic stop is provided on the spreader below the pendulum support mounting, so that the pendulum rod cannot slip through in the unloaded state. As a result, a relative movement occurs between the top end of the pendulum support and the lifting yoke when the spreader moves relative to the lifting yoke. This vertical relative movement is detected as a signal and evaluated.

In addition, for antirotation locking of the ropes connected to the lifting yoke in the region of its corner points, the rope ends are accommodated in parallelpiped like rope connections. An adjusting device in the form of intermediate shims (for compensating for the lifting rope length) is provided at each rope.

The present invention can supplement conventional spreaders in such a way as to automate them. The manufacturing costs of the present invention are relatively low with the cost for the apparatus and the bearing points on the spreader being slight.

Other objects and features of the present invention will become apparent from the following detailed description considered in conjunction with the accompanying drawings, It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, embodiments of the present invention are illustrated in schematic form, wherein like reference characters denote similar elements throughout the several views, as follows.

DETAILED DESCRIPTION OF THE PRESENTLY PREFERRED EMBODIMENTS

Figure 1:
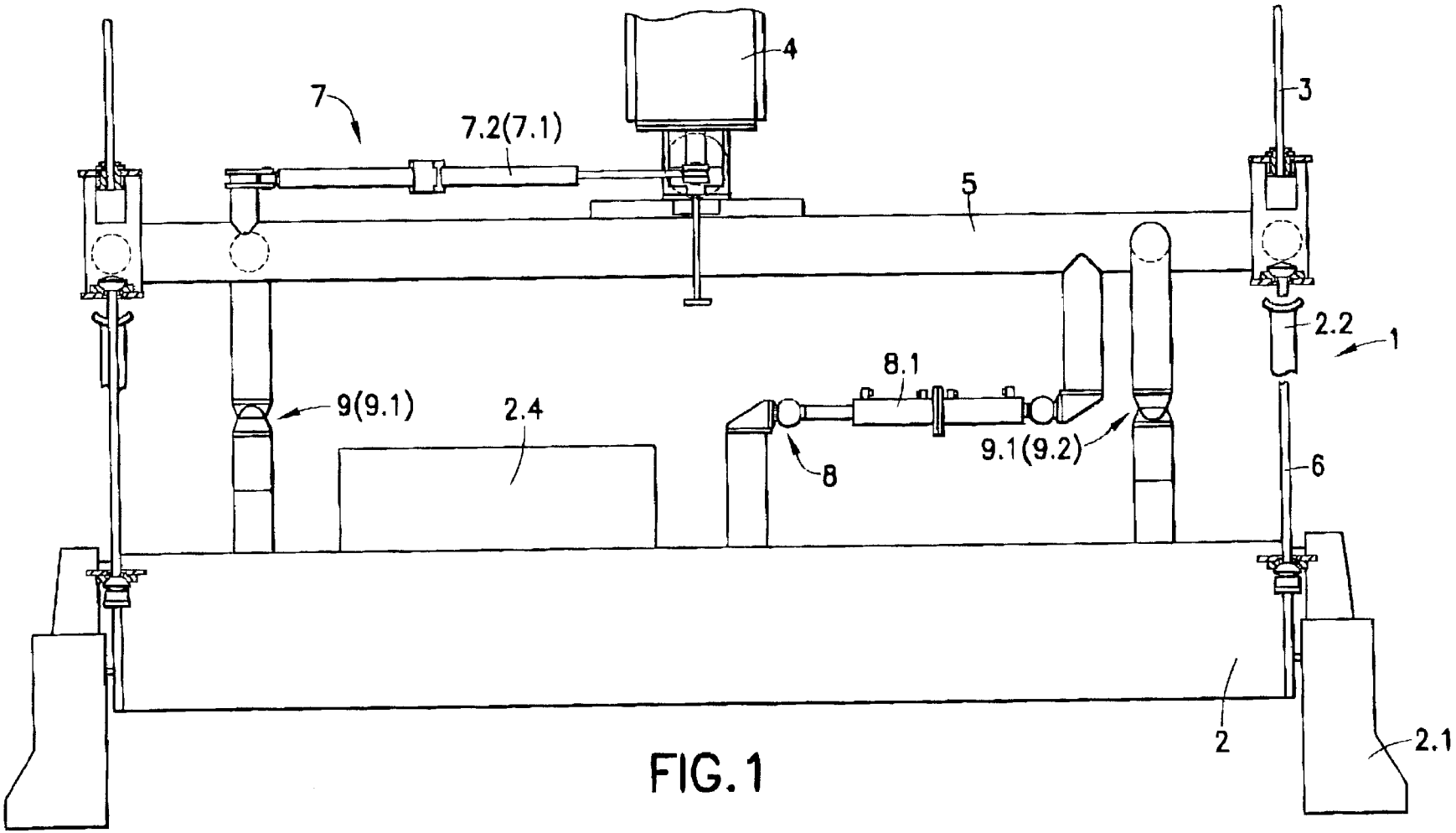
FIG. 1 is a front view of the apparatus according to the present invention.

Referring now to FIG. 1, a front view of the present invention with a spreader 2 is shown. Four lifting ropes 3 are fastened to the top side of the lifting yoke 5, whereas a guide column 4 acts in the center of the lifting yoke 5 as the rigid load guide. The actual apparatus 1 according to the present invention consists of the lifting yoke 5, the pendulum supports 6, the top pushing and pivoting plane 7, the bottom, longitudinally acting pushing plane 8 with the cylinder pair 8.1, and the bottom, transversely acting pushing plane 9 with the cylinder pairs 9.1 and 9.2. The spreader 2, the corner guides 2.1, the brackets 2.2, the power pack 2.4, the lifting ropes 3, and the guide column 4 can also be seen in FIG. 1. The two brackets 2.2 on the top side of the spreader 2 are intended as an end stop for receiving the lifting yoke 5.

Figure 2:
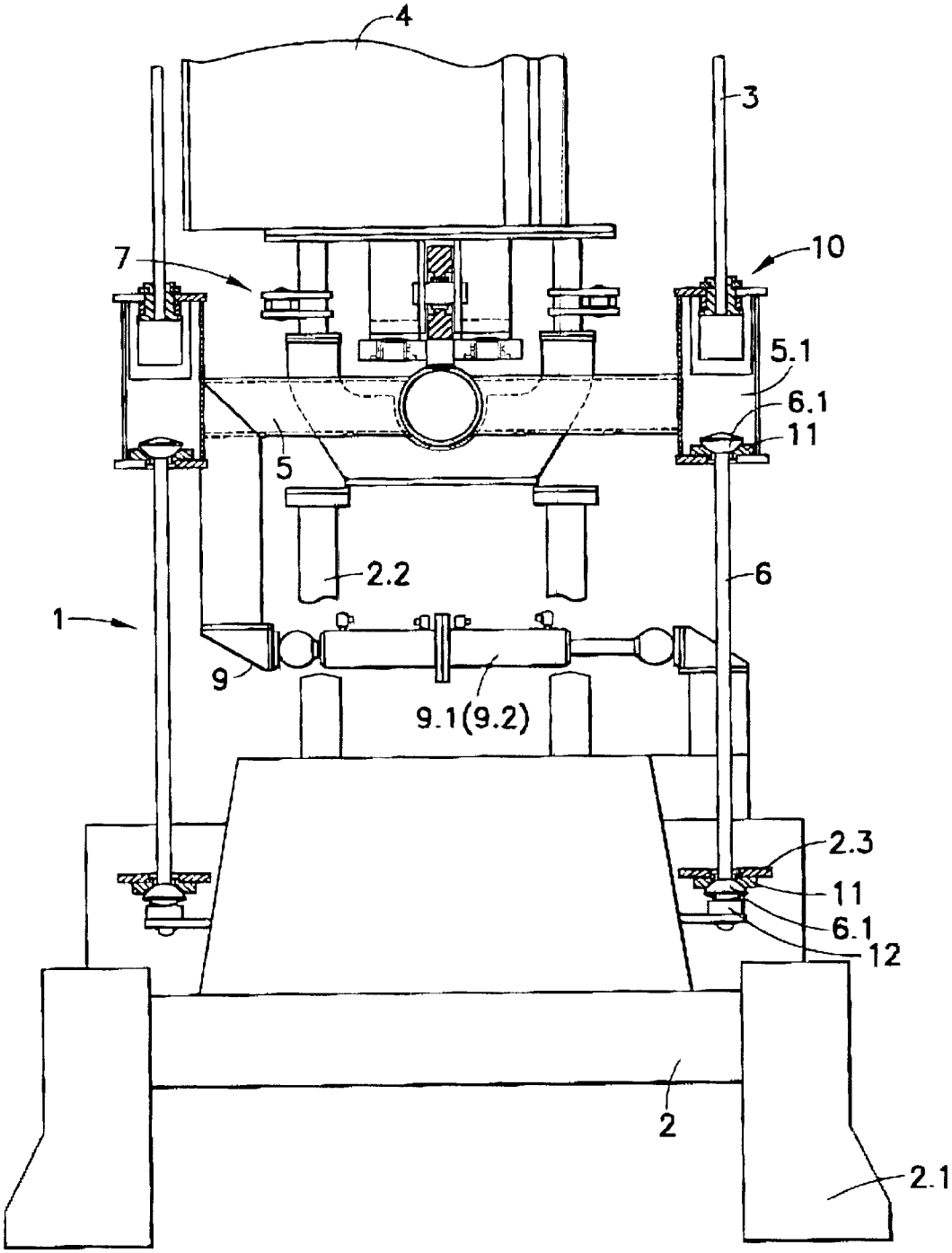
FIG. 2 is a side view of the apparatus according to the present invention.

Referring now to FIG. 2, the same parts as described above are designated in the same way in a side view of the present invention. The tubular corner points 5.1, which are open toward the longitudinal side of the lifting yoke 5, accommodate the lifting ropes 3 and the pendulum supports or rods 6 in special bearings (not visible here). The rope fixed points 10 on the top end of the corner points 5.1 form the receptacle for the lifting ropes 3. The ball heads 6.1 of the tie rods 6 on the bottom end of the corner points 5.1 and on the basic steel structure of the spreader 2.3 are mounted in split cups 11. The stop 12 below the pendulum support 6 prevents the latter from slipping through.

Figure 3:
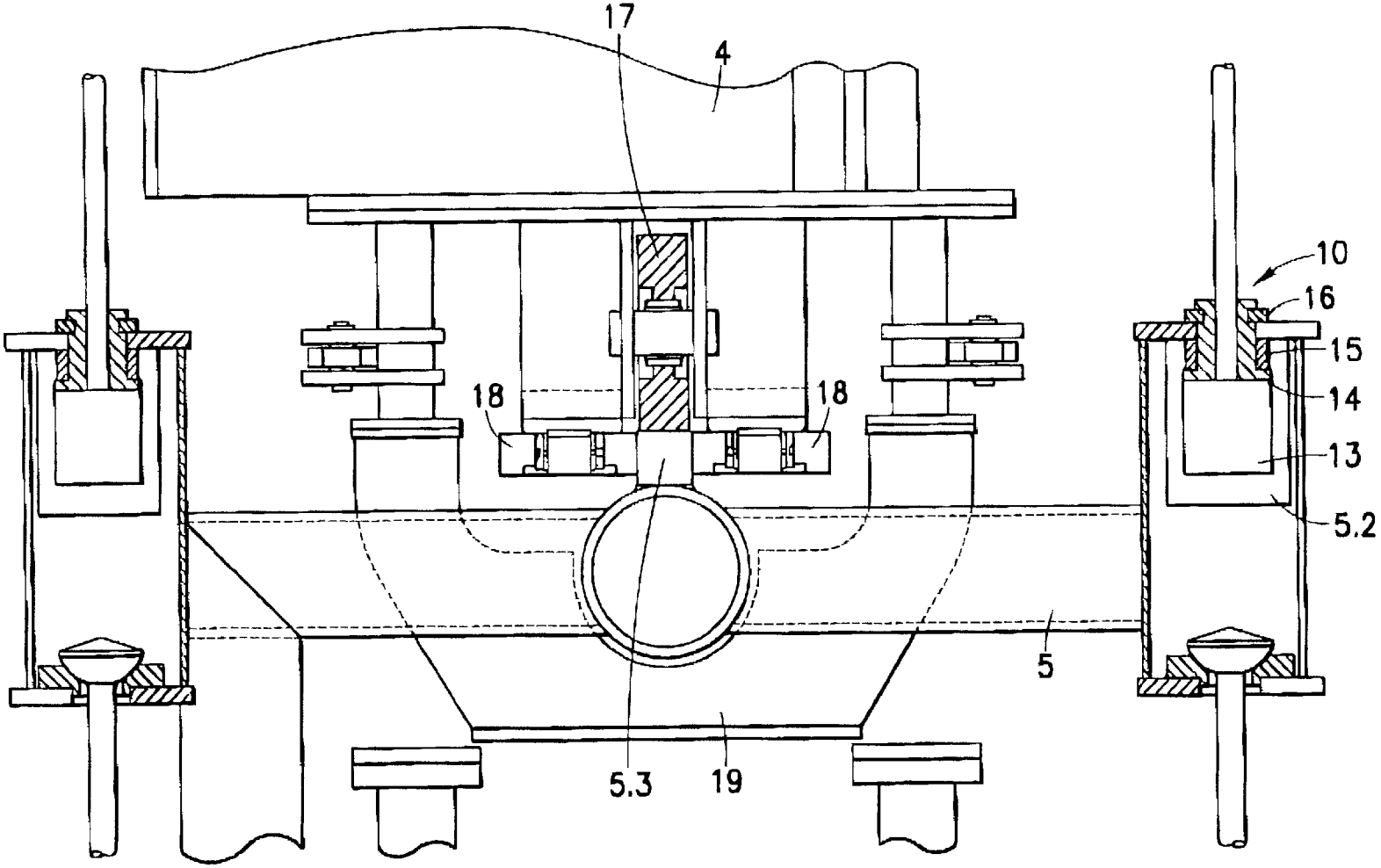
FIG. 3 is a detail view of FIG. 2.

Referring now to FIG. 3, the components can be seen better in an enlarged detail representation. The rope fixed point 10 consists of a parallelpiped shaped cast rope connection 13 with a funnel shaped split rope sleeve 14, the slotted compensating disks 15, and the split end disk 16. The parallelpiped shaped rope connection bears with a side face against an antirotation locking means 5.2. In the center of the lifting yoke 5, a running rail 5.3 and a supporting roller unit, consisting of a running roller 17 and two supporting rollers 18, form the bearing point of the guide column 4. The safety stirrup 19 prevents the guide column 4 from being lifted from the lifting yoke 5.

Figure 4:
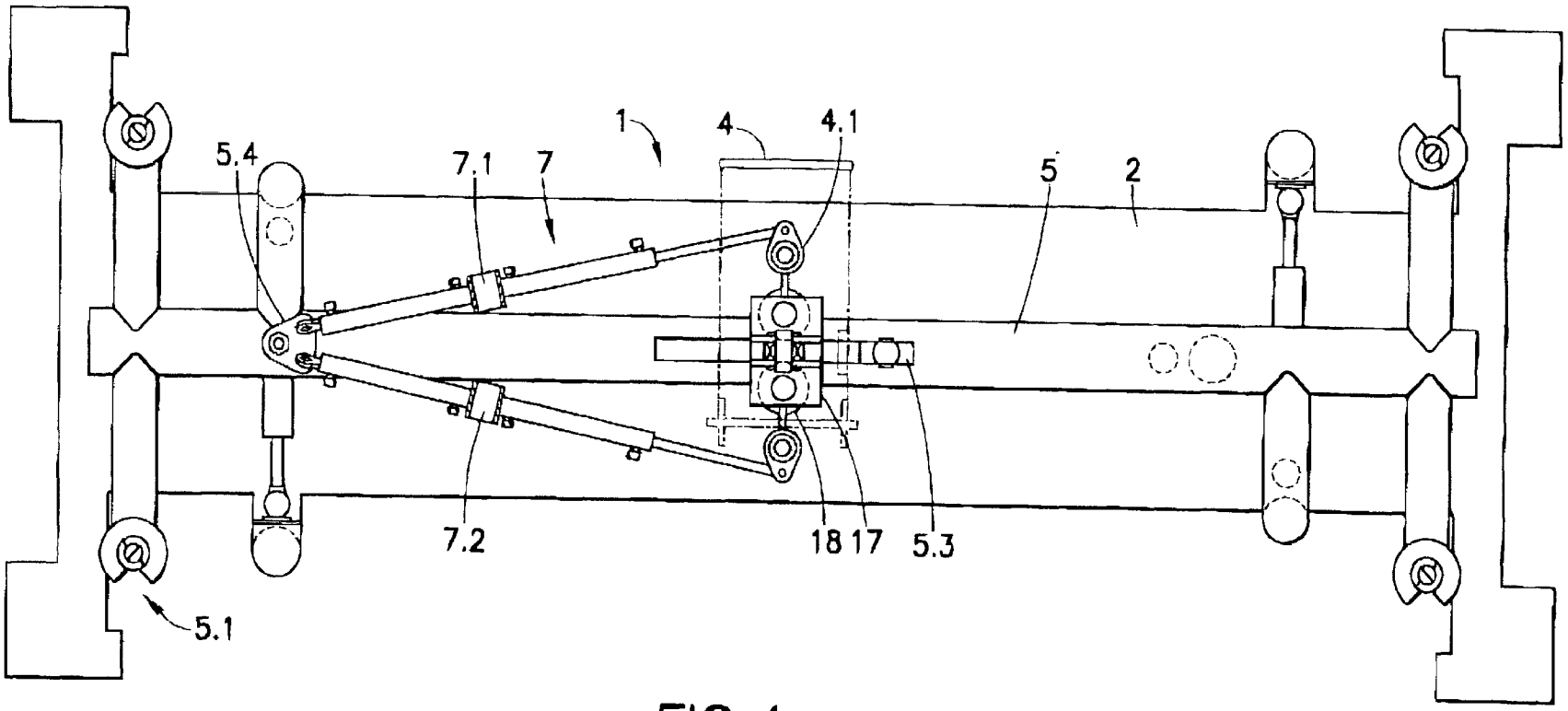
FIG. 4 is a plan or top view of the apparatus according to the present invention.

Turning now to FIG. 4, the present invention is shown in its initial position, i.e., in the zero position. The spreader 2, the guide column 4, the lifting yoke 5, and the top pushing and pivoting plane 7 can be seen. The cylinder pairs 7.1 and 7.2 of the top pushing and pivoting plane 7 are mounted on the cylinder fixed point 4.1 of the guide column 4 and on the cylinder fixed point 5.4 of the lifting yoke 5. The tubular corner points 5.1, which are open toward the longitudinal side of the lifting yoke 5, accommodate the lifting ropes 3 and the pendulum supports 6. The sensor system (not shown) for detecting the vertical position of the pendulum supports 6 is likewise located in the tubular corner point 5.1 of the lifting yoke 5. In the center of the lifting yoke 5, the running rail 5.3 and the supporting roller unit form the bearing point of the guide column 4.

Figure 5:
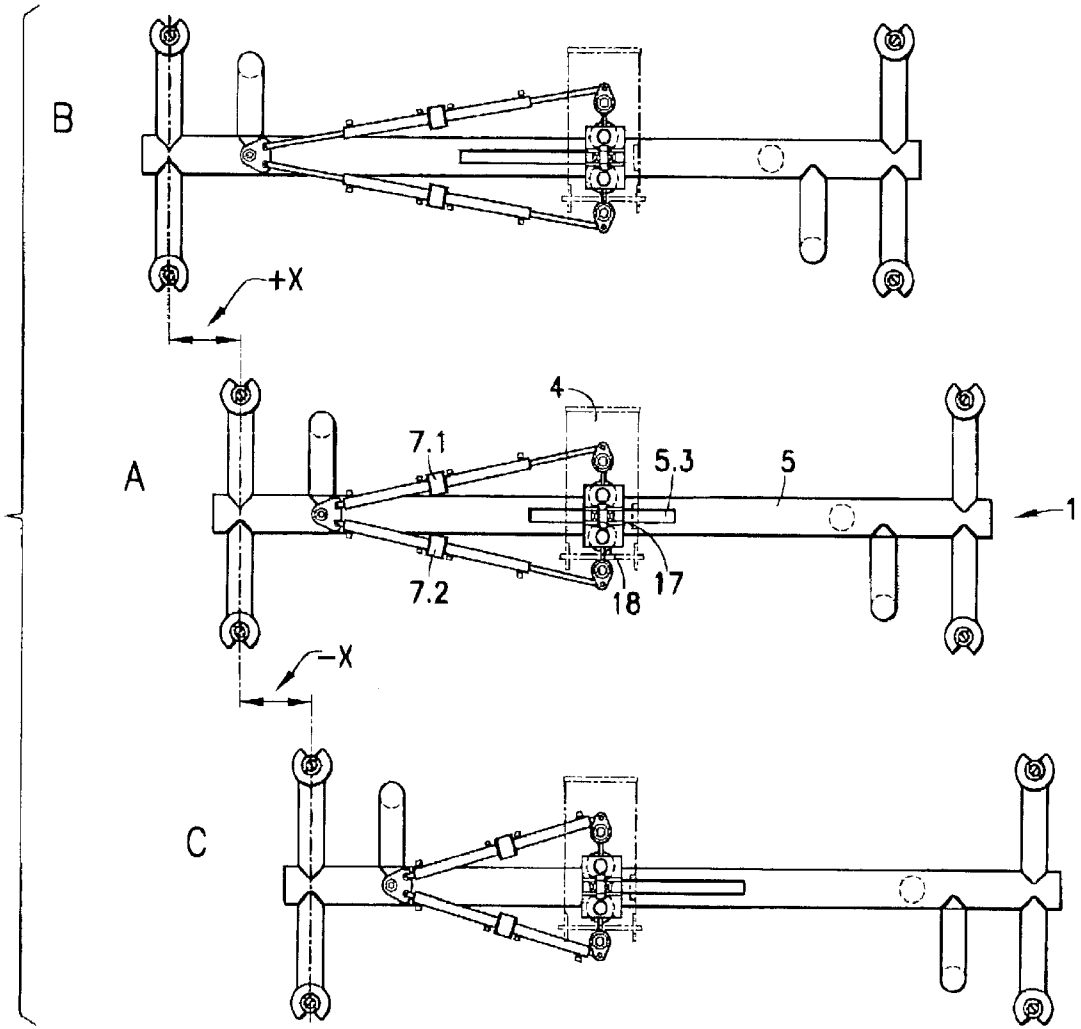
FIG. 5 shows the representation according to FIG. 4 in three phases A, B, and C.

Referring now to FIG. 5, three horizontal displacement positions, A, B, and C, are shown. The initial position A, shows the zero position of the apparatus. The cylinders of cylinder pairs 7.1 and 7.2 lying toward the center are fully extended. Position B, with a relative horizontal offset between the guide column 4 and the lifting yoke 5 of +x, is reached when all the cylinders are fully extended. Position C, with a relative horizontal offset between the guide column 4 and the lifting yoke 5 of −x, is reached when all the cylinders are fully retracted. During the horizontal displacement operation, the running roller 17 is held laterally by the two supporting rollers 18, and runs on the running rail 5.3.

Figure 6:
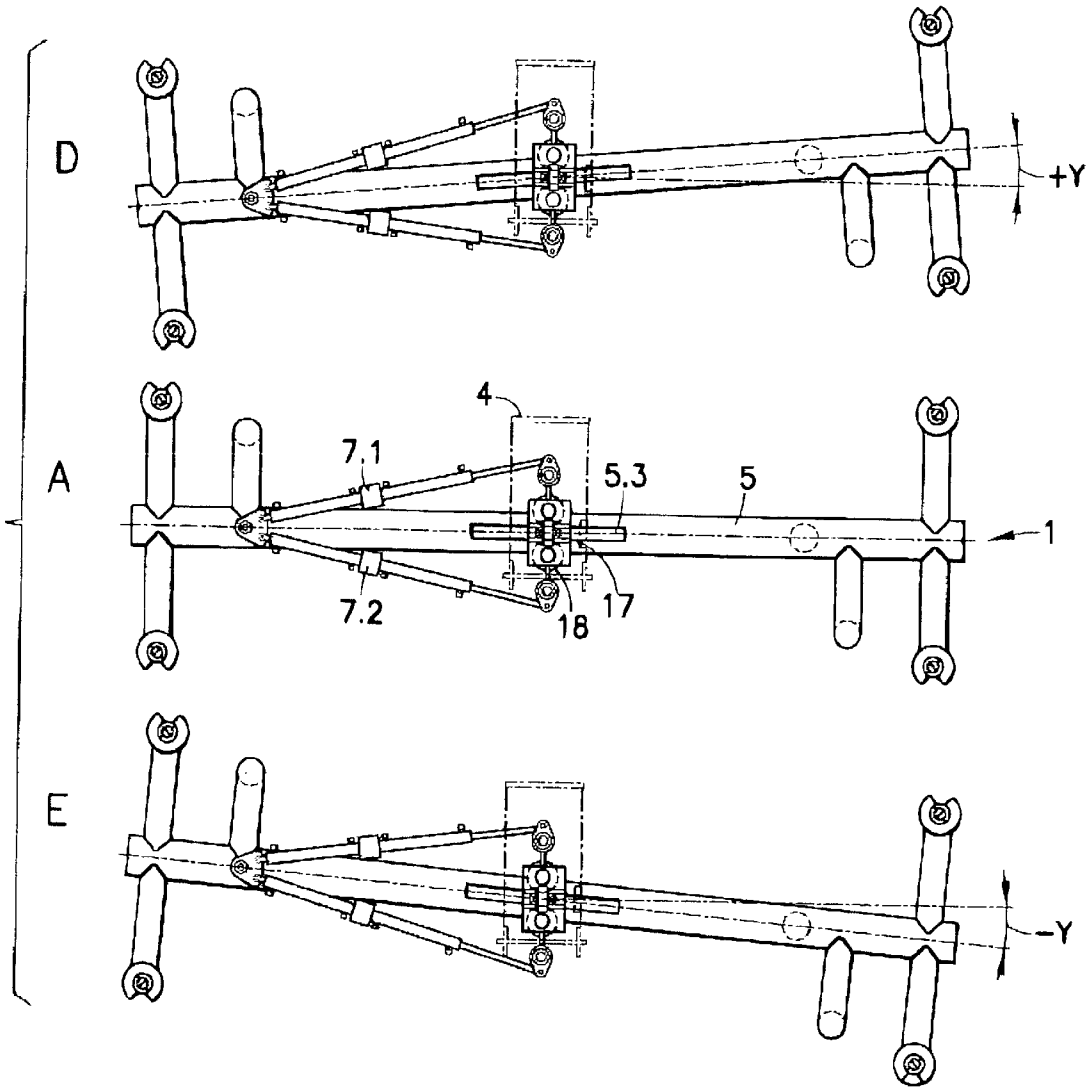
FIG. 6 shows the apparatus according to FIG. 5 in various pivoted positions.

Turning now to FIG. 6, the present invention is again shown in its zero position, i.e., in initial position A. Again, the center cylinders of cylinder pairs 7.1 and 7.2 are fully extended. Position D, with a relative pivoting movement between the guide column 4 and the lifting yoke of +y, is reached when the center of the top cylinder is fully extended and the bottom cylinder is extended by a limited amount. Position E, with a relative pivoting movement between guide column 4 and lifting yoke 5 of −y, is reached when the center of the bottom cylinder lying is fully extended and the top cylinder is extended by a limited amount. During these pivoting movements, the running roller 17, which is held laterally by the two supporting rollers 18, compensates for movement relative to the running rail 5.3. If necessary, the supporting rollers 18 may be pressed in a flexibly supported manner against the running rail 5.3. Superimposition of the movements from FIGS. 5 and 6 is possible. In other words, simultaneous lateral and pivotal adjustments of the load are possible.

Figure 7:
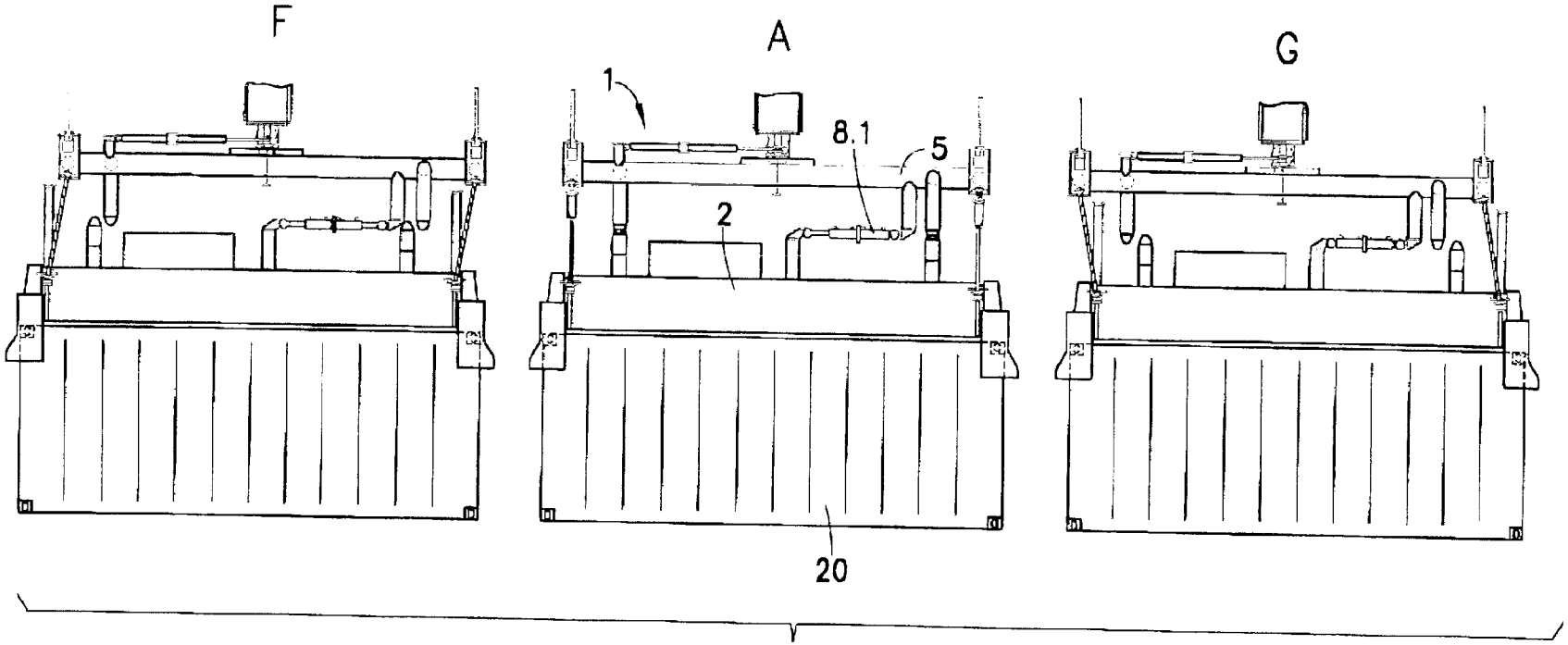
FIG. 7 is a front view of the handling operation.

Referring now to FIG. 7, a front view of a handling operation using the present invention is shown in the zero position, i.e., in the initial position A. Of the cylinder pair 8.1 longitudinally acting pushing plane 8, the cylinder lying toward the center is fully extended. In position F, the relative horizontal offset between the spreader 2 and the lifting yoke 5 is reached when both cylinders are fully extended. In position G, the relative horizontal offset between spreader 2 and lifting yoke 5 is reached when both cylinders are fully extended. The relative horizontal offset between zero position and positions F and G can be damped by specific hydraulic pressure in the cylinder pairs, depending on the wind force acting on the apparatus 1, the spreader 2, and the container 20.

Figure 8:
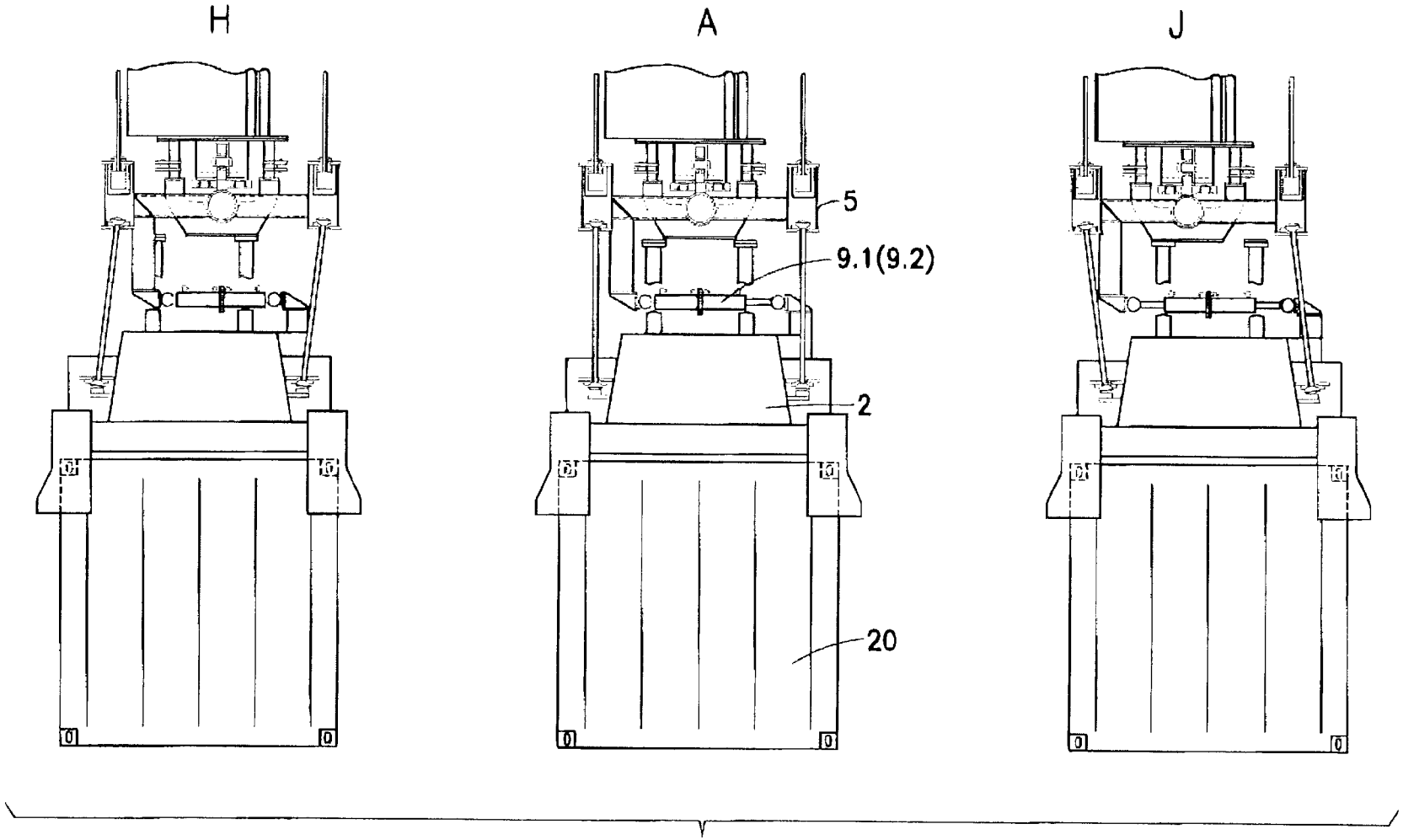
FIG. 8 is a side view of the handling operation.

Referring now to FIG. 8, a side view of the handling operation using the present invention is shown in the zero or A position. One cylinder of each of the cylinder pairs 9.1 and 9.2 of the bottom, transversely acting pushing plane 9 is fully extended in the zero position. In position H, a relative horizontal offset between spreader 2 and lifting yoke 5, is reached in a traverse direction when both cylinders are fully retracted. In position J, a relative horizontal offset between spreader 2 and lifting yoke 5 in a second, opposite traverse attraction, is reached when both cylinders are fully extended. The possible relative horizontal offset between zero position and the positions H and J can be damped by specific hydraulic pressure in the cylinder pairs, depending on the wind force acting on the apparatus. Superimposition of the movements from FIGS. 7 and 8 is possible. Superimposition of the movements from FIGS. 5/6 and 7/8 is also possible. In other words, tilting movement of the lifting yoke in the traverse and longitudinal directions is possible both sequentially and simultaneously.

Figure 9:
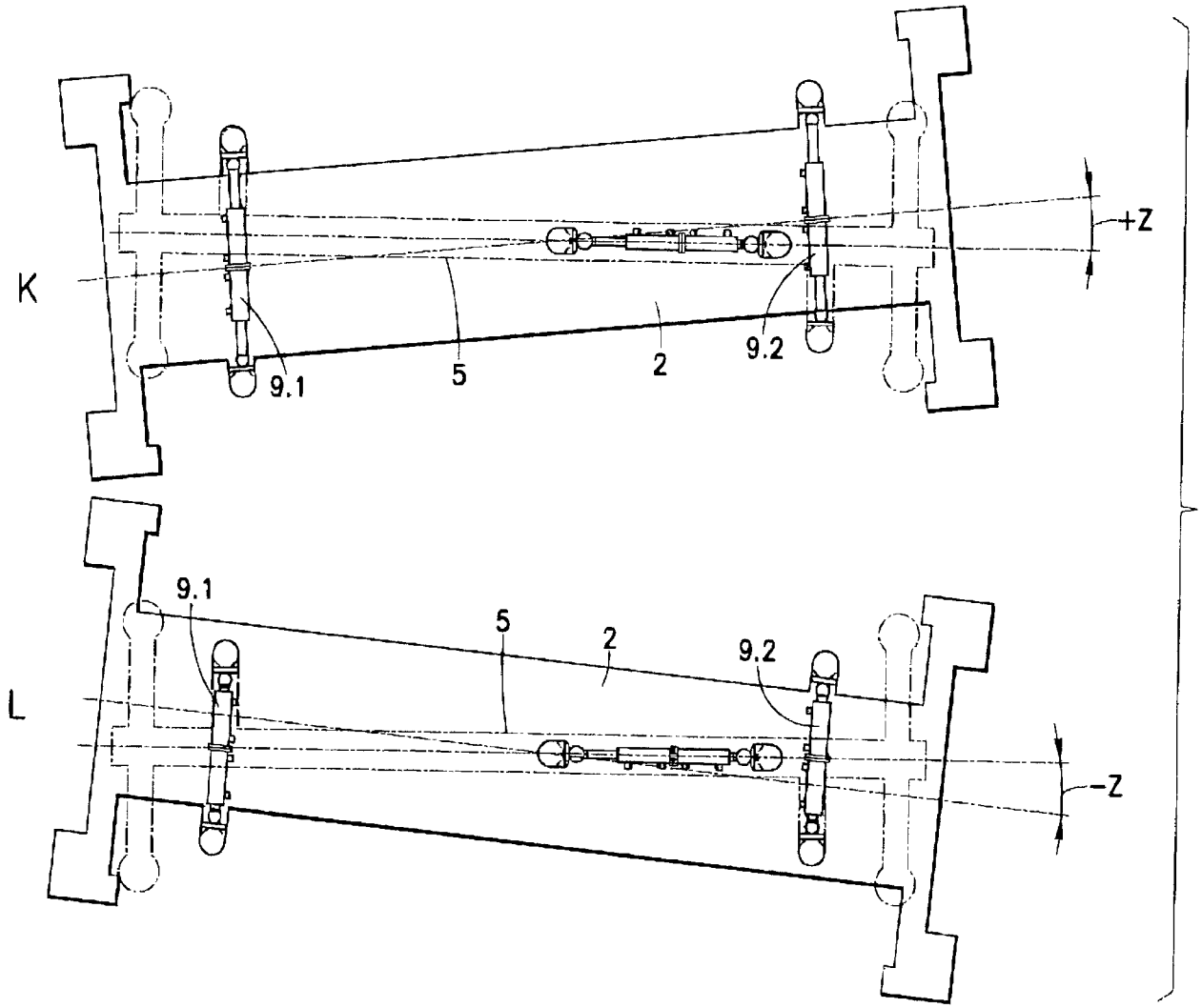
FIG. 9 is a plan view of the apparatus according to the present invention in two pivoted positions.

Referring now to FIG. 9, a plan view of the present invention is shown. Specifically, position K is show, having a relative pivoting movement between the spreader 2 and the lifting yoke 5 of +z. It is obtained when all the cylinders of the cylinder pairs 9.1 and 9.2 of the bottom, transversely acting pushing plane 9 are fully extended. Position L is shown, having relative pivoting movement between the spreader 2 and the lifting yoke 5 of −z. It is obtained when all the cylinders of the cylinder pairs 9.1 and 9.2 of the bottom, transversely acting pushing plane 9 are fully retracted.

Figure 10:
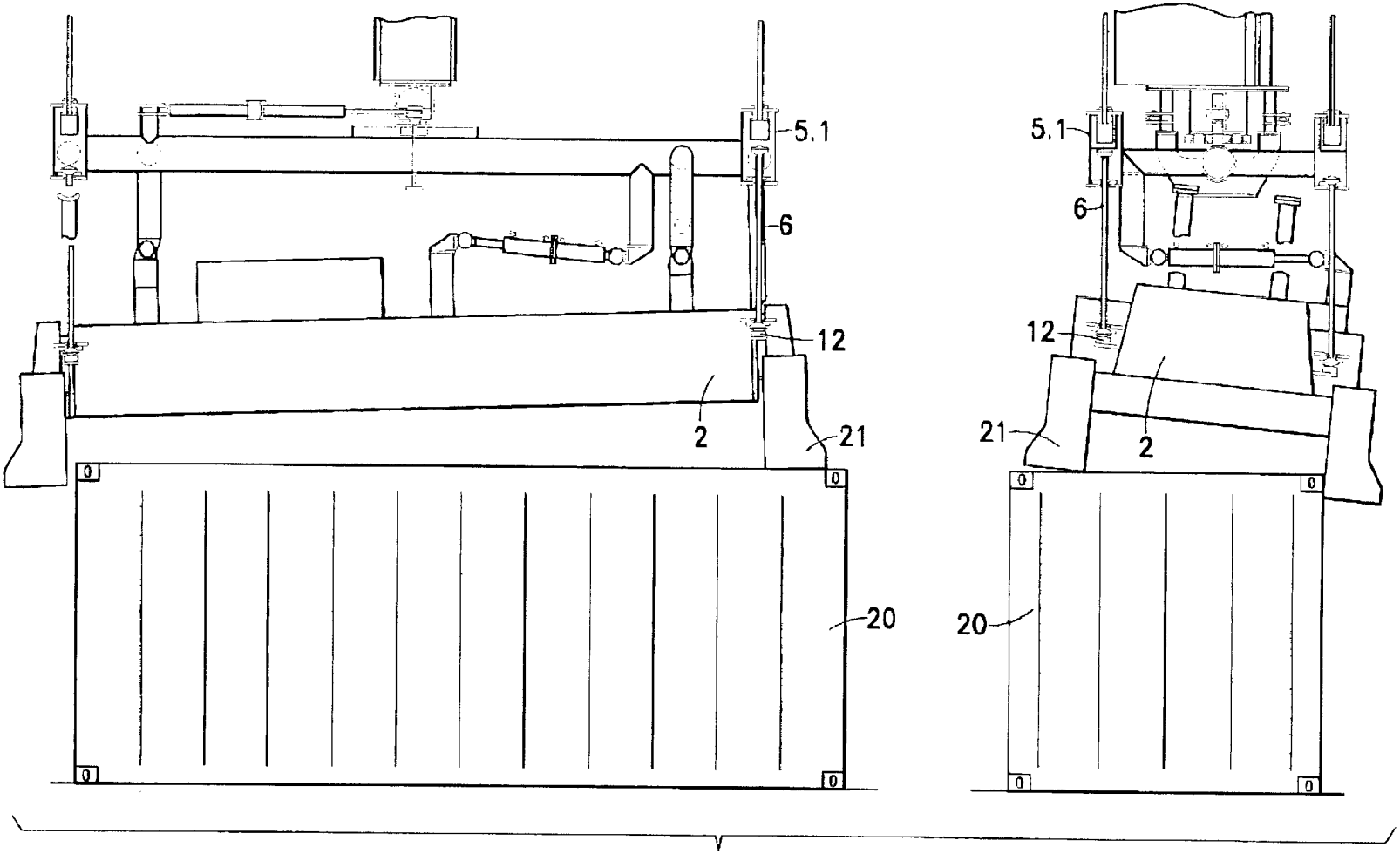
FIG. 10 shows front and side views of a failed handling operation.

Referring now to FIG. 10, front and side views of a handling operation using the present invention are shown. In particular, the function of the sensory monitoring of the handling operation is illustrated. During an attempt to pick up and incorrectly placed container 20, a sensor activated by the vertically displaced pendulum support 6 in the tubular corner point 5.1, signaled a malfunction. The corner guides 2.1 of the spreader 2 were not able to compensate for the excessive offset. The handling operation was stopped. The relieved pendulum support 6 is supported during this operation on the stop 12 of the spreader 2.

Figure 11:
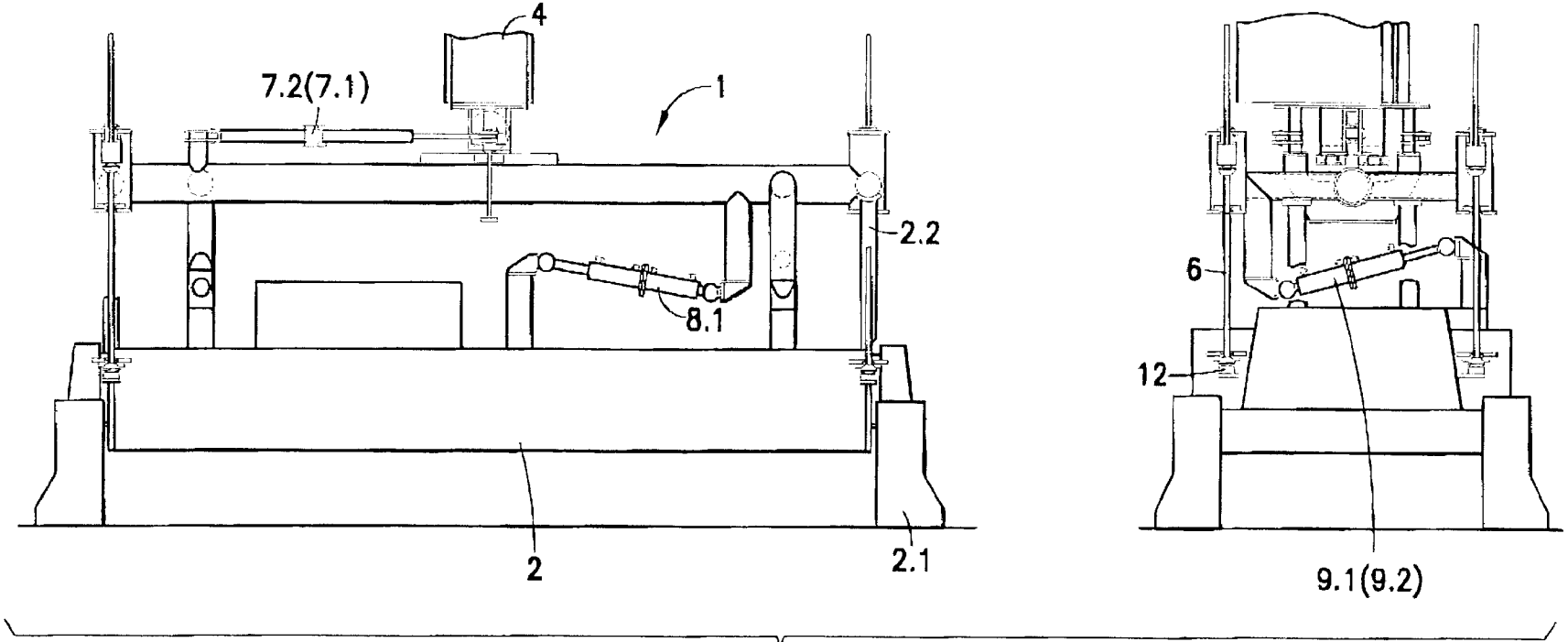
FIG. 11 shows the apparatus according to the present invention in the service position.

Referring now to FIG. 11, the present invention and the spreader 2 are shown in a service position. The spreader 2 is disposed on its corner guides 2.1. The guide column 4 and lifting yoke 5 are supported on a total of four brackets 2.2, which are located on the top side of the spreader 2. The hydraulic system of cylinder pairs 8.1, 9. 1, and 9.2 is switched to a floating position in this situation. The relieved pendulum supports 6 are supported on the stops 12 of the spreader. In this position, the present mention can be released from the guide column 4 and the lifting ropes 3 when required. The apparatus and spreader then form a transport unit which can be easily handled.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An automated load handling apparatus for loads having comers and load suspension means, the load handling apparatus comprising:

a spreader having corner points;

a lifting yoke having an essentially horizontally extending supporting framework including corner points, the lifting yoke being suspendable over a region of the comer points of the spreader;

four axially displaceable pendulum supports arranged between the lifting yoke and the spreader for supporting the lifting yoke;

a rigid load guide having two sides and including a lifting mechanism having four ropes, wherein each rope corresponds to a single corner of the lifting yoke and is fastenable to the load suspension means of the spreader;

a first cylinder pair 7.1, 7.2 arranged between the rigid load guide and the lifting yoke so as to provide torque support of the lifting yoke relative to the load guide and so as to at least one of displace and pivot the lifting yoke relative to the load guide; and sensor means arranged in the first cylinder pair for detecting relative orientation of at least one of the lifting yoke relative to the spreader and the lifting yoke relative to the load guide.

2. The load handling apparatus according to claim 1, wherein each of the cylinders of the first cylinder pair comprises two first piston/cylinder units capable of assuming a retracted state, wherein the two first piston/cylinder units describe sides of an isosceles triangle at least in the retracted state, each first unit being linked to the lifting yoke in a region of a tip of the isosceles triangle and each first unit being fastened in an articulated manner in a common horizontal plane to a side of the load guide in a region opposed to the tip.

3. The load handling apparatus according to claim 2, wherein each first piston/cylinder unit comprises double acting individual cylinders having base flanges, the individual cylinders of each unit being connected to one another at the base flanges.

4. The load handling apparatus according to claim 1, further comprising:

a guide running in a longitudinal direction of the lifting yoke for supporting the yoke in its transverse direction; and wherein the load guide comprises a vertically guided guide column of a handling device.

5. The load handling apparatus according to claim 4, wherein the guide is a guide rail, and further comprising:

a running roller arranged at a front end of the guide column so as to ride on the guide rail and be rotatable about a horizontal axis; and lateral supporting rollers capable of rolling on flanks of the guide rail, wherein the running rollers and the supporting rollers are of crowned design.

6. The load handling apparatus according to claim 1, further comprising:

a second cylinder pair 9.1, 9.2 comprising essentially horizontal second piston/cylinder units having cylinder spaces and being arranged transversely between the lifting yoke and the spreader and arranged lengthwise relative to the spreader, so as to damp the load during a handling operation by depressurizing the cylinder spaces when the spreader is set down on a container.

7. The load handling apparatus according to claim 1, further comprising:

a mechanical stop between the lifting yoke and the spreader for limiting a vertical clearance space between the lifting yoke and the spreader.

8. The load handling apparatus according to claim 1, further comprising:

a plurality of hydraulic units for driving the first cylinder pair;

an electrical control for actuating the first cylinder pair; and a data communication device operatively connected to the first cylinder pair for monitoring and controlling the relative position of the spreader and the lifting yoke, wherein the hydraulic units, the electrical control and the data communication device are arranged on the spreader.

9. The load handling apparatus according to claim 1, wherein the sensor means is configured so as to sense and evaluate all orientations of the spreader relative to the lifting yoke.

10. The load handling apparatus according to claim 1, wherein the sensor means is configured so as to sense orientation of the spreader in a bridge and trolley travel direction by electronically determining movement of the pendulum supports relative to a suspension in the lifting yoke.

11. The load handling apparatus according to claim 1, wherein the ropes have rope ends arranged in parallelepiped rope connections, the rope ends being attached to the lifting yoke in the region of the comer points, the load handling apparatus further comprising:

intermediate shims arranged on each rope for adjusting a length of the rope.

* * * * *